United States Patent [19]

Strandberg et al.

[11] Patent Number: 4,914,024

[45] Date of Patent: Apr. 3, 1990

[54] MICROBIAL SOLUBILIZATION OF COAL

[75] Inventors: Gerald W. Strandberg, Farragut; Susan N. Lewis, Knoxville, both of Tenn.

[73] Assignee: The United States of America as represented by the United States Department of Energy, Washington, D.C.

[21] Appl. No.: 146,622

[22] Filed: Jan. 21, 1988

[51] Int. Cl.[4] ..... C12P 1/00

[52] U.S. Cl. ..... 435/41; 435/166; 435/170; 435/262; 435/281; 435/886; 530/300

[58] Field of Search ..... 435/281, 41, 166, 170, 435/262

[56] References Cited

U.S. PATENT DOCUMENTS 4,775,627 10/1988 Attia et al. ..... 435/282

OTHER PUBLICATIONS

Antai et al.—Chem. Abst., vol. 95, (1981) p. 129,026d.

Crawford—Chem. Abst., vol. 96 (1982), p. 124734u.

M. H. Rogoff et al., "The Mocrobiology of Coal in Bacterial Oxidation of Phenanthrene", *J. Bacteriol.*, vol. 73, pp. 264–268 (1957).

M. H. Rogoff et al., "Microbiology of Coal", U.S. Bureau of Mines, Information Circular 8075 (1962).

L. A. Korburger, "Microbiology of Coal: Growth of Bacteria in Plain and Oxidized Coal Slurries", *Proc. W. Va. Acad. Sci.*, vol. 36, pp. 26–30 (1964).

M. S. Cohen et al., "Degradation of Coal by the Fungi *Polyporous versicolor* and *Poria monticola*", *Appl. Environ. Microbiol.*, vol. 24, pp. 23–27 (1982).

C. D. Scott, G. W. Strandberg and S. N. Lewis, "Microbial Solubilization of Coal", *Biotechnol. Prog.*, vol. 2, p. 131 (1986).

Fakoussa et al., "Koehle als Microbielles Substrat unter Aeroben Bedingungen", Kolloquium in der Bergbau-Forschug Gmblt, Essen, pp. 41–49 (1983).

*Primary Examiner*—Sam Rosen

*Attorney, Agent, or Firm*—Katherine P. Lovingood; Stephen D. Hamel; William R. Moser

[57] ABSTRACT

This invention deals with the solubilization of coal using species of Streptomyces. Also disclosed is an extracellular component from a species of Streptomyces, said component being able to solubilize coal.

12 Claims, No Drawings

MICROBIAL SOLUBILIZATION OF COAL

BACKGROUND OF THE INVENTION

1. Field of the Invention

The present invention relates to a cell-free preparation and process for the microbial solubilization of coal into solubilized coal products. More specifically, the present invention relates to bacterial solubilization of coal into solubilized coal products and a cell-free bacterial byproduct useful for solubilizing coal.

2. Description of Related Art

Thermal and chemical processes for the conversion of coal to liquid and gaseous products generally require somewhat extreme temperature, pressure and chemical conditions. The severity of the operating conditions may commonly include pressures in excess of 3,000 psi and temperatures in excess of 800 degrees Fahrenheit. These processes usually also require a significant capital investment. Because of the relatively mild operating conditions associated with many biological processes, there has been a recurring interest in the potential use of microorganisms for coal processing.

There have been earlier suggestions that microorganisms may be able to solubilize native coal. M. H. Rogoff et al, "The Microbiology of Coal in Bacterial Oxidation of Phenanthrene," *J. Bacteriol.*, Vol. 73, pp. 264–68 (1957); M. H. Rogoff et al, "Microbiology of Coal," U.S. Bureau of Mines, Information Circular 8075 (1962); J. A. Korburger, "Microbiology of Coal: Growth of Bacteria in Plain and Oxidized Coal Slurries," *Proc. W. Va. Acad. Sci.*, Vol. 36, pp. 26–30 (1964). In recent experiments, certain strains of fungi have been shown to produce a liquid product when cultured on the surface of lignite coal in the presence of humid air. M. S. Cohen et al, "Degradation of Coal by the Fungi *Polyporous versicolor* and *Poria monticola*," *Appl. Environ. Microbiol.*, Vol. 24, pp. 23–27 (1982); C. D. Scott, G. W. Strandberg, and S. N. Lewis, "Microbial Solubilization of Coal," *Biotechnol. Prog.*, Vol. 2, p. 131 (1986). The coal solubilization product is highly polar, water-soluble material of moderately high molecular weight having a high degree of aromaticity. Coal solubilization by these fungi appears, at this time, to be limited to conditions in which the coal must be in contact with aerial mycelia.

Spectroscopic evidence has also been found for the use of coal as a substrate for a bacterial strain of Pseudomonas isolated from a mixed enrichment culture growing in the present of finely ground bituminous coal. Fakoussa et al, "Koehle als Microbielles Substrat unter Aeroben Bedingungen," Kolloquium in der Bergbau-Forschung Gmblt, Essen, pp. 41–49 (1983). Fakoussa et al suggested that both an enzyme and a surface active agent produced by the organism were involved in attacking the coal. Fakoussa et al does not appear to demonstrate that the organism causes both a substantial decrease in the weight of coal and an increase in the carbon content of the culture broth. Fakoussa et al further appears to fail to demonstrate that coal solubilizing activity is produced in the absence of coal.

It is therefore desirable to effect microbial solubilization by using bacteria. It is further desirable to accomplish bacterial solubilization of coal with a submerged bacterial culture that does not require fungal aerial mycelia. It is further desirable to obtain a cell-free substance capable of solubilizing coal since such a substance would significantly enhance potential microbial solubilization techniques.

SUMMARY OF THE INVENTION

Therefore, it is an object of the present invention to provide for the solubilization of coal by the use of bacteria.

It is a further object of the present invention to provide a means to accomplish coal solubilization in a submerged process.

Another object of the present invention is to provide a cell-free substance capable of solubilizing coal.

Still, a further object of the present invention is to provide a bacterial byproduct capable of solubilizing coal.

The foregoing objects and others are accomplished in accordance with the present invention, generally speaking, by providing a process for the bacterial solubilization of coal which may be carried out in submerged conditions and which includes introducing coal to a medium containing a bacterial culture so as to cause microbial solubilization and so as to produce solubilized coal products which may be removed from the medium.

The present invention is also generally described as encompassing a non-cellular bacterial byproduct capable of solubilizing coal so that solid portions of coal are converted into liquid form.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the present invention will become apparent to those skilled in the art from this detailed description.

DETAILED DESCRIPTION OF THE INVENTION

According to a preferred embodiment of the present invention, microbial solubilization of coal is accomplished by employing the bacterial species *Streptomyces setonii* 75 Vi2 and *Streptomyces viridosporous* T7A. These bacteria are known lignin-degrading bacteria. Both organisms were obtained from Prof. Don L. Crawford, Dept. of Bacteriology and Biochemistry, Univ. of Idaho, Moscow, Idaho. *S. setonii* 75 Vi2 was deposited into the American Type Culture Collection (ATCC) and was designated as ATCC strain 39116. *S. viridosporous* T7A was deposited into the ATCC and was designated as ATCC strain 39115. This strain was tested for solubilizing activity and the test results indicated that its solubilizing characteristics do not differ from those of the organisms obtained directly from D. Crawford.

The microbial solubilization process of the present invention is capable of solubilizing various kinds of coal. Coals that are preferred for use in the present invention include North Dakota lignite, Mississippi lignite, Texas lignite, and Wyoming-Dakota (Wyodak) Subbituminous coal. The origins and properties of these coals are described, for example, in Soctt et al, "Microbial Solubilization of Coal," *Biotechnol. Prog.*, Vol. 2, p. 131 (1986). Some of these coals are pretreated or preoxidized with an oxidizing agent so as to render the coal uniformly and more readily susceptible to microbial solubilization. Suitable oxidizing agents include, for example, nitric acid, hydrogen peroxide, and ozone. During the oxidization pretreatment process the coal is exposed to the oxidizing agent by, for example, immersing the coal in an oxidizing agent solution or exposing the coal to an oxidizing agent gas. The coal may require sterilization after pretreatment and before exposure to microbial solubilization. Other suitable oxidation pretreatment conditions may be employed. Preferably the coal is in the form of coal particles in the particle size range of from 10 to 100 mesh and, most preferably, from 10 to 20 mesh.

The medium employed in the process of the present invention must be capable of supporting microbial growth, such as bacterial growth, and maintaining the coal-solubilizing activity of the microorganisms employed in the process. An essential feature of the medium appears to be the provision of an appropriate organic nitrogen source which the microorganisms can modify or metabolize in order to exhibit coal-solubilizing activity. Suitable medium ingredients include, for example, agar, Neopeptone (manufactured by Difco Laboratories, Detroit, Mich.), Neopeptone plus maltose, Yeast extract (Difco), Amberex-Crude (manufactured by Amber Laboratories, Juneau, Wis.), cheese whey, and Casamino acids (Difco). Suitable nitrogen sources also includes complex nitrogen compounds, such as Peptone, Proteose-peptone, Tryptone, and Tryptose (complex nitrogen nutrients obtained from Difco, Detroit, Mich.). Further nitrogen sources include amino acids, such as Glutamic acid, Valine, and Asparagine. The medium does not require a carbohydrate. The coal-solubilizing activity of the microorganisms in the medium is usually accompanied by an increase in alkalinity of the medium.

Other conditions associated with the medium of the process of the present invention include temperature, humidity, and the time period during which the microoganisms are cultured. These conditions can be determined by one of ordinary skill in the art with reference to the examples indicated below.

The present invention also encompasses an extracellular bacterial preparation that is capable of solubilizing coal. In a preferred embodiment, this extracellular component is isolated from a bacterial culture of *Streptomyces setonii* 75 Vi2 which produces this component. The presence of this soluble, cell-free component capable of solubilizing coal was conclusively demonstrated by using a sterilizing filter (0.22μ or 0.45μ, Millipore filter) to remove all cells from a seven day old *S. setonii* 75 Vi2 culture broth and contacting coal with the sterilized broth which resulted in a solubilizing activity on the coal. The active cell-free component in the broth is likely not a protein, enzyme, or some combination since solubiizing activity cannot be eliminated by treating the sterilized broth with any of several proteases. The cell-free component has an unusually high heat stability since autoclaving of the sterilized broth for up to one hour at 121 degrees Celcius did not completely destroy solubilizing activity.

The cell-free component capable of solubilizing coal may be isolated by various methods. For example, a sterilizing filter, such as a 0.22μ or 0.45μ Millipore filter, may be used in a filtering method in order to isolate the component. Gel permeation chromatography may possibly also be used to isolate the cell-free component. With this method, sodium dodecyl sulfate (SDS) may be used to enhance separation and recovery of the cell-free component.

EXAMPLES

In order to further define the specifics of the present invention, the following examples are provided and are intended to illustrate the concepts of the coal-solubilizing processes and preparations associated with the present invention and not limit the particulars of the present invention.

Example 1

Coal is microbially solubilized on the surface of a bacterial culture. The bacterial species *Streptomyces setonii* 75 Vi2 and *S. viridosporous* T7A are cultured on the surface of Sabouraud Maltose agar (Neopeptone by Difco, 10 g/L; Maltose, 40 g/L; agar, 15 g/L) at 30° C. and greater than 80% relative humidity for 7 to 10 days. Coal solubilization of low-ranked coals such as North Dakota lignite and preoxidized Wyodak subbituminous coal is evidenced by the production of a black liquid commensing within a few hours after adding the coals to the surface of the cultures. Up to 55% solubilization of the Wyodak coal was observed after 14 days contact with *S. setonii* 75 Vi2.

Example 2

In order to test the solubilization of coal by a submerged bacterial culture, coal was added to shake flask cultures of *S. setonii* 75 Vi2. The culture was grown in Sabouraud Maltose broth at 30° C. and the flask was shaken at 100 RPM with a two inch stroke. The coals used were presized (1–2 mm) particles of either a North Dakota lignite (American Colloid Co., Skokie, Ill.) or a subbituminous coal (Wyodak, Amax Coal Co., Indianapolis, Ind.). The coals were previously sterilized by autoclaving at 121° C. for 40 minutes. The Wyodak subbituminous coal had been previously treated by soaking in 8 N $HNO_3$ for 48 hours in order to render the coal more susceptible to solubilization. After two days incubation with the cultures, the coal and microorganisms were removed from the culture broth by centrifugation. The residual coal was separated from the microorganisms by repeated, gentle agitation in deionized, distilled water followed by decanting the liquid with the lighter microorganism cells suspended in it. The dry weight of the remaining coal residue was determined after oven drying at 95° to 100° C. for 16–18 hours. The results of these experiments are presented in Table 1. It is noted that blackening of the broth began within 3–4 hours after adding the coals to the seven day shake cultures. No apparent solubilization occurred in shake flasks of *S. viridosporous* T7A.

TABLE 1

The solubilization of coal by a submerged culture of *Streptomyces setonii* 75 Vi2

| Conditions | Coal[a] | Dry weight of coal (mg) initial | Dry weight of coal (mg) final[b] | Weight change(%) |
|---|---|---|---|---|
| Sterile medium | NDV | 542 | 517 | −4.6 |
| | Wyodak-PT | 509 | 518 | +2.0 |
| Submerged cultures[c] | NDV | 508 | 289 | −43.0 |
| | | 511 | 371 | −27.5 |
| | Wyodak-PT | 513 | 98 | −81.0 |

[a]NDV is a North Dakota lignite obtained from American Colloid Co., Skokie, IL. Wyodak-Pt is a subbituminous coal obtained from Amax Coal Co., Indianapolis, IN. It was pretreated by soaking for 48 h in 8 M $HNO_3$.
[b]Final dry weights of residual coal after 48 h incubation with cultures.
[c]Coal was added to 7 day shake cultures (Sabouraud Maltose medium, 30° C., 100 rpm, 2 inch stroke).

Example 3

In order to demonstrate the coal-solubilizing activity of a cell-free component of the present invention, coal solubilization was carried out after isolating the cell-free extract from the bacterium *Streptomyces setonii* 75 Vi2. The results of coal solubilization experiments are indicated in Table 2.

TABLE 2

Results of Treatment of Coal with an Extracellular Product from *Streptomyces setonii* 75 Vi2

| Coal | | Dry Weight of Coal (mg) Initial | Final | % Weight loss |
|---|---|---|---|---|
| North Dakota Lignite | Extract[2] + coal | 550 | 423 | 23.0 |
| | Autoclaved filtered extract + coal | 512 | 444 | 12.3 |
| | Control – fresh sterile medium | 534 | 497 | 6.9 |
| Wyodak Subbituminous[3] | Extract + coal | 513 | 162 | 68.5 |
| | Autoclaved filtered extract + coal | 506 | 256 | 49.3 |
| | Control – fresh sterile medium | 509 | 518 | (2.0) gain |

[1]Dry weight of residual coal following two days incubation with filtered broths (shaken at 30° C., 100 RPM, 2 inch stroke). Residual coal was washed several times with distilled water prior to oven drying (95–100° C., 16–18 h). The coals were sterilized by autoclaving (40 min, 121° C.) prior to addition to broths.
[2]Extracts from 7 day cultures of *S. setonii* 75 Vi2 grown on Sabouraud Maltose broth, 30° C., 100 RPM.
[3]Wyodak subbituminous coal was preoxidized by soaking in 8 N $HNO_3$, 48 h followed by extensive washing in deionized, distilled $H_2O$.

Example 4

Various media were tested for their ability to support growth and the production of coal-solubilizing activity by a bacterial culture. In this case, *Streptomyces setonii* 75 Vi2 was used. The results of the various media tested are indicated in Table 3. It is noted from the results that a carbohydrate is not required in the medium and can be detrimental. For example, Neopeptone plus maltose or Neopeptone alone supported the production of coal-solubilizing activity, whereas no activity is found when glucose was substituted for maltose.

TABLE 3

Results of Employing Various Media with a Bacterial Culture of *Streptomyces setonii* 75 Vi2

| Medium[1] | Medium pH Initial | Final(7 d) | Coal solubilization[2] % loss |
|---|---|---|---|
| Neopeptone[3] (1%) plus maltose (4%) | 5.8 | 8.9 | 45,50; 69,64; 65,62 |
| Neopeptone[3] (1%) | 7.1 | 8.9 | 39,29 |
| | | 8.5 | 38,40 |
| Neopeptone[3] (1%) plus glucose (1%) | 7.4 | 7.9 | 0 |
| Yeast extract[3] (1%) | 7.0 | 8.8 | 62,60 |
| Amberex-EHC[4] (1%) | 5.8 | 6.0 | 0 |
| Amberex-crude[4] (2%) | 5.1 | 8.8 | 48,47 |
| Whey[5] (2%) | 5.9 | 8.2 | 32,36 |
| Casamino acids[3] (3%) | 5.9 | 9.0 | 68,72 |

TABLE 3-continued

Results of Employing Various Media with a Bacterial Culture of *Streptomyces setonii* 75 Vi2

[1]Medium components were dissolved at the concentrations indicated in demineralized, distilled water and sterilized at 121° C., 20 min.
[2]Coal solubilization was measured using cell-free broths of *S. setonii* 75 Vi2 grown on the medium for 7 days (filter sterilized with 0.45 μ filter). A known quantity of nitric acid-treated Wyodak subbituminous coal was shaken in the cell-free broths for 2 days (30° C.). The residual non-solubilized coal was recoverod by filtration and the dry weight determined.
[3]Difco Laboratories, Detroit MI.
[4]Amber Laboratories, Juneau, WI.
[5]Whole powdered cheese whey (partially demineralized), Flav-O-Rich, Inc. Knoxville, TN.

Example 5

In order to further test media which support bacterial culture growth and coal-solubilizing activity, various complex nitrogen sources and amino acids were introduced to a bacterial culture of *Streptomyces setonii* 75 Vi2. The results of these further media tests are summarized in Table 4.

TABLE 4

The Suitability of Various Nitrogen Sources for Growth and Coal Solubilization by *Streptomyces setonii* 75 Vi2

| Nitrogen Source[1] | (mg dry wt)[2] Initial | Coal Final | Solubilized Coal[3] (%) |
|---|---|---|---|
| Complex N Compounds | | | |
| Peptone[4] | 341 | 173 | 49 |
| | 306 | 168 | 4S |
| Peptose-peptone[4] | 312 | 129 | 59 |
| | 312 | 136 | 56 |
| Tryptone[4] | 312 | 150 | 2 |
| | 320 | 164 | 49 |
| Tryptose[4] | 315 | 139 | 56 |
| | 313 | 125 | 60 |
| Amino Acids | | | |
| Glutamic acid[5] | 329 | 71 | 78 |
| (after cell growth) | 340 | 80 | 77 |
| Glutamic acid | 181 | 177 | 2 |
| (sterile control) | 177 | 174 | 2 |
| Valine[5] | 333 | 306 | 8 |
| (after cell growth) | 356 | 322 | 10 |
| Valine | 179 | 179 | 0 |
| (sterile control) | 204 | 202 | 1 |
| Asparagine[5] | 314 | 158 | 50 |
| (after cell growth) | 321 | 149 | 1 |
| Asparagine | 193 | 190 | 2 |
| (sterile control) | 193 | 189 | 2 |

[1]*Streptomyes setonii* 75 Vi2 was cultured on the nitrogen sources for 7 days at 30° C. After 7 day growth the cells were removed by filtration (0.45 μ Millipore filter), and the sterile culture broths tested for coal solubilizing activity.
[2]The coal used was a nitric acid treated (2 days, 8N $HNO_3$).
[3]Percent coal solubilized after 2 days at 30° C. in 50 ml broth.
[4]The complex nitrogen sources were the only nutrients supplied (3% w/v in 100 ml water). All were obtained from Difco, Detroit MI.
[5]The amino acids (0.5% w/v) were supplemented with 0.05% KCl, 0.05% $MgSO_4.7H_2O$, 0.01% $FeSO_4.7H_2O$, and $K_2HPO_4$ as inorganic nutrients. The volume of culture broth used was 100 ml.

Example 6

The effect of SDS on coal-solubilizing activity of the cell-free culture broth was determined. It was found that SDS enhanced coal solubilization by approximately 20%. The results are shown in Table 5.

TABLE 5

| Results of Gel Permeation Chromatography Using SDS | |
|---|---|
| Addition | Coal Solubilization % loss |
| Cell-free culture broth | 50, 47 |
| Cell-free culture broth plus 0.1% SDS | 59, 63 |
| SDS only | 6 |

The invention being thus described, it will be obvious that the same be varied in many ways. Such variations are not to be regarded as a departure from the spirit and scope of the invention and all such modifications as would be obvious to one skilled in the art are intended to be included within the scope of the following claims.

We claim:

1. A process for the microbial solubilization of coal into solubilized coal products which comprises:

introducing coal to a medium containing a bacterial culture which comprises a species selected from the group consisting of *Streptomyces setonii* 75 Vi2 and *Streptomyces viridosporous* T7A so as to cause microbial solubilization of said coal to produce solubilized coal products.

2. The process as in claim 1, wherein said bacterial culture is a submerged bacterial culture.

3. The process as in claim 1, wherein said bacterial culture is cultured on Sabouraud Maltose agar for 7 to 10 days before said coal is introduced to said bacterial culture.

4. The process as in claim 1, wherein said coal is selected from a member of the group consisting of North Dakota lignite and subbituminous coal.

5. The process as in claim 2, wherein said bacterial culture comprises *Streptomyces setonii* 75 Vi2.

6. The process as in claim 1, wherein said bacterial culture comprises *Streptomyces setonii* 75 Vi2 and wherein said medium contains a member selected from the group consisting of neopeptone, neopeptone plus maltose, Yeast extract, Amberex-crude, cheese whey, Casamino acids, and mixtures thereof.

7. The process of claim 1, wherein said coal is a member selected from the group consisting of North Dakota lignite, Mississippi lignite, Texas lignite, and Wyoming-Dakota subbituminous coal.

8. The process as in claim 1, wherein said bacterial culture comprises *Streptomyces setonii* 75 Vi2 and wherein said medium contains peptone, proteose-peptone, tryptone, tryptose, glutamic acid, valine, asparagine, or mixtures thereof.

9. A process for the microbial solubilization of coal to solubilize coal products which comprises:

introducing coal to a medium containing an extracellular substance from a bacterial culture of *Streptomyces setonii* 75 Vi2 so as to cause microbial solubilization of said coal to produce solubilized coal products.

10. The process as in claim 9, wherein sodium dodecyl sulfate is used to enhance activity of said extracellular substance.

11. The process as in claim 9, wherein said solubilized coal products are removed from said medium.

12. An extracellular coal solubilizing component produced by *Streptomyces setonii* 75 Vi2 wherein said component has a molecular weight of less than 10,000 daltons.

* * * * *